US007077063B2

(12) United States Patent
Petersen

(10) Patent No.: US 7,077,063 B2
(45) Date of Patent: Jul. 18, 2006

(54) STACKABLE HAND STAMP

(76) Inventor: Craig J. Petersen, 410 Meacham, Park Ridge, IL (US) 60068

( * ) Notice: Subject to any disclaimer, the term of this patent is extended or adjusted under 35 U.S.C. 154(b) by 60 days.

(21) Appl. No.: 10/950,054

(22) Filed: Sep. 24, 2004

(65) Prior Publication Data

US 2006/0065142 A1 Mar. 30, 2006

(51) Int. Cl.
*B41K 1/42* (2006.01)

(52) U.S. Cl. ..... 101/333; 101/405

(58) Field of Classification Search ..... 101/333, 101/327, 405, 371, 368
See application file for complete search history.

(56) References Cited

U.S. PATENT DOCUMENTS 1,334,540 A * 3/1920 Jones ..... 101/333
2,891,472 A * 6/1959 Holzer ..... 101/333
3,020,838 A * 2/1962 Prost ..... 101/333
3,090,304 A * 5/1963 Sulkie ..... 101/333
5,313,885 A * 5/1994 Winston ..... 101/405
5,909,709 A * 6/1999 An et al. ..... 101/405
5,942,312 A * 8/1999 Venkataraman et al. . 428/195.1
5,996,493 A * 12/1999 Okumura et al. ..... 101/333
6,164,202 A * 12/2000 Takami ..... 101/333
6,499,398 B1 * 12/2002 MacNeil ..... 101/327
2005/0166776 A1 * 8/2005 Petersen ..... 101/333

* cited by examiner

*Primary Examiner*—Anthony H. Nguyen
(74) *Attorney, Agent, or Firm*—Knechtel, Demeur & Samlan

(57) ABSTRACT

A hand stamp that has a frame member that has mounted therein an image forming stamping member. This can be either an ink cartridge or a flexible rubber die. The cartridge has an ink storage layer and an image forming layer with an image thereon. The die is a conventional raised indicia die. There is a ledge surrounding the inside of the frame member that has an adhesive applied to it to hold either the ink cartridge or the rubber die. A bottom tray is snugly yet removably attached to the bottom of the frame. The bottom tray protects the stamping member and has a protruding post that provides for mounting multiple stamps, one on top of another.

21 Claims, 2 Drawing Sheets

STACKABLE HAND STAMP

BACKGROUND AND SUMMARY OF THE INVENTION

This invention relates to hand stamps and more particularly to a hand stamp that allows the user to stack multiple stamps one on top of the other. This invention also allows the interchangeability of either a rubber die and inkpad stamp or a self inking stamp to be used in the stacking design.

In the first embodiment, the stamp uses a printing surface made from an ink permeable material that allows ink to pass from an ink reservoir, cartridge or other ink storage media, through the printing surface and onto the object being marked. This eliminates the need for a separate stamp inkpad. These stamps are referred to as hand stamps.

This type of stamp is illustrated in U.S. Pat. No. 5,942,312 issued to Venkataraman et al. This patent discloses a pre-inked thermoplastic foam which has open cells in the area that is designed to transfer ink and closed or sealed cells in the area which is designed to be impermeable to ink. The pre-inked thermoplastic foam is pre-inked before the image is formed on the thermoplastic material. Thus if there is a problem with the image, the entire pad including the ink, is wasted. Furthermore there may be difficulties in forming an image on a pre-inked thermoplastic foam as it may be messy or require special handling due to the ink in the pre-inked thermoplastic foam. The pre-inked thermoplastic foam is mechanically held to the stamp and assembled at the factory. The pre-inked thermoplastic foam is not designed to be installed or removed in the field, nor is it stackable.

U.S. Pat. No. 5,996,493 issued to Okumura et al. illustrates a pre-inked stamp that uses an ink pack to supply ink to the porous stamp. The ink pack ruptures when the ink pack is pressed against a cutting device in the stamp. There is a transparent film thermally attached to the stamp surface to protect the stamp surface during transport and storage. The transparent film is removed just before using the stamp for printing images. The porous stamp portion is thermally attached to the holder at the factory and is not designed to be installed in the field nor is it stackable.

Another stamp is disclosed in U.S. Pat. No. 6,164,202 issued to Takami. This patent discloses a stamp unit comprising a holder, which is placed in a stamp manufacturing device for making a stamping surface on a stamp material. The holder interacts with the stamp manufacturing device to properly position the holder in the manufacturing device. An image is formed on the surface of the stamp forming material by fusing portions on the surface. The stamp forming material is saturated with ink and ink is allowed to flow out from the non fused portions onto a printing sheet forming the image.

In the second embodiment, the stamp's printing surface is made from rubber or other flexible material. The printing surface is securely mounted on a handle that is grasped by the user. There are raised numbers, letters and other indicia on the face of the printing surface of the stamp. The printing surface is placed in contact with an inkpad so that ink is transferred to the raised indicia. The inked printing surface is pressed against the receiving surface and ink is transferred from the raised indicia onto the ink receiving surface. Repetition of the stamping process requires that the printing surface be pressed against the inkpad each time an image is to be transferred.

A problem not solved by the prior art devices is providing a stackable stamp that permits either embodiment of hand stamp, i.e. the stamp pad and printing surface with raised indicia or the self inking stamp to be stacked by utilizing similar frame components. Providing stackability allows several stamps with different indicia to be stacked one on top of the other. This minimizes desk and storage space while providing the user all of the benefits of individually made stamps that are not stackable. It is also desirable if the stamp is designed for both embodiments to be intermixed and stacked on top of each other.

Applicant's invention addresses and solves the problems of the prior art devices. The invention comprises a frame member that supports both embodiments of the image forming layer. In the first embodiment, the frame supports an ink cartridge that has an ink storage layer and a porous foam layer with an image forming stamp material on the surface. The two layers are in intimate contact with each other and are supported by the frame member. The image forming layer is made of a porous resin layer. Portions of the porous resin layer are melted and solidify into impermeable areas that are ink impermeable, and other portions of the porous resin layer remain unmelted and allow ink to pass. In this manner the stamping image is defined. The frame member can alternatively support the second embodiment of a rubber die with raised indicia thereon. The raised indicia defines the image, which when inked, can transfer the image to an image receiving surface.

There is a bottom tray that covers the rubber die or the foam layer with the image thereon. The bottom tray acts as a dust cover if there is a foam layer. An inkpad is inserted into the tray if there is a rubber die with raised indicia thereon. The bottom tray has a center post that is received into a receiving hole on the top surface of a stamp positioned below the upper stamp. In this manner the frame members and their associated image forming surface can be stacked one on top of the other.

OBJECTS AND ADVANTAGES

It is an object to provide a stackable hand stamp that uses a frame member that supports and securely retains an ink cartridge and permeable foam printing pad in one embodiment and also supports a flexible rubber die printing surface in a second embodiment. It is a related object to provide a stackable hand stamp that can stack both embodiments in one hand stamp.

An advantage is that the invention uses one frame assembly to support both embodiments of printing surfaces which results in an inexpensively manufactured hand stamp.

These and other objects and advantages will be apparent from reviewing the following Description of the Drawings and Description of the Preferred Embodiment.

DESCRIPTION OF THE PREFERRED EMBODIMENT

Figure 1:
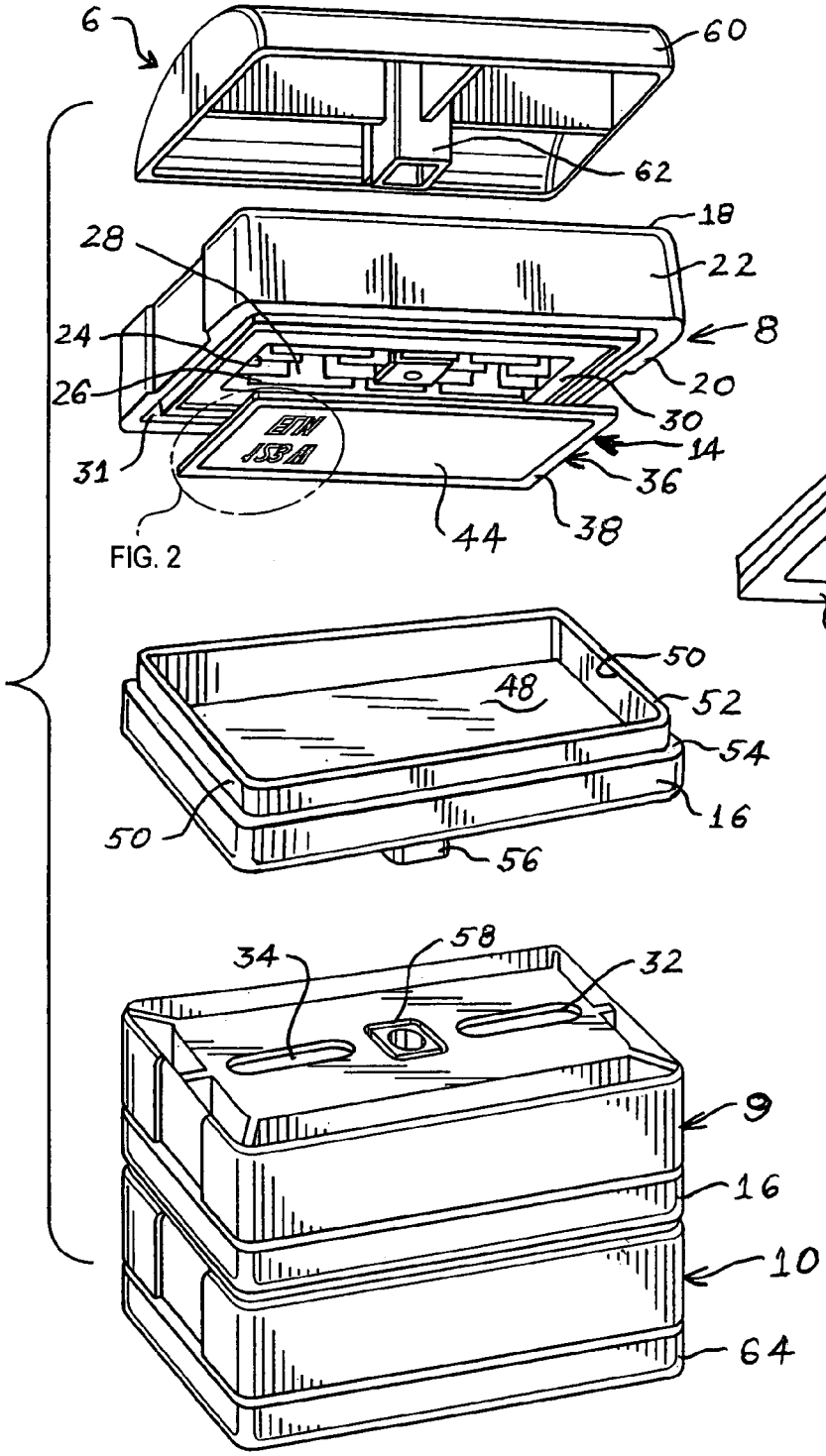
FIG. 1 is an exploded perspective view of a stackable hand stamp illustrating a first embodiment of a hand stamp with an image forming stamp member having a combination ink cartridge and foam image forming portion adapted for mounting on the frame member.

Turning to FIG. 1 there is illustrated a stackable hand stamp 10 of the present invention. The stamp 10 is designed to use both types of image forming stamping member which are: (1) a combination ink cartridge and foam image forming stamping member or (2) a rubber die with raised indicia thereon for forming the image. FIG. 1 illustrates the first embodiment of an image forming stamping member. As illustrated, the stackable stamp 6 is comprised of a first stamp 8, a second stamp 9 and a third stamp 10. The main elements of the first and second stamps 8 and 9 are at least a frame member 12, an image forming stamping member 14 and a bottom tray 16. The frame member 12 has a top 18, a bottom 20 and sidewalls 22. There is a frame cavity 24 within the frame member 12. A plurality of baffles 26 separated by ink channels 28 is disposed within the frame cavity 24. The baffles 26 extend vertically downward from the top 18 to a point above the bottom 20. The frame member 12 is illustrated as rectangular as this is the most common stamp configuration, although other geometric shapes such as square or circular can also be used.

There is a ledge 30 that extends around the entire perimeter of the frame member 12 inside of the frame cavity 24. The ledge 30 is separated from the sidewalls 22 by a receiving groove or channel 31 surrounding the ledge 30. The ledge 30 extends from the sidewalls 22 toward the center of the frame cavity 24. There are two ink entrance holes 32 and 34 in the top 18 through which ink is poured as will be described later.

The image forming stamping member 14 is comprised of an ink cartridge 36 with an outer edge 38 surrounding it. The ink cartridge 36 is comprised of an ink storage layer 40 and image forming layer 42 that has an image surface 44. This is the printing side or stamp surface. There is also an opposite non-printing side that is in intimate contact with the ink storage layer 40. The image forming layer 42 is made from a porous soft resin in which optical energy absorbing material is dispersed. To produce an image 46 onto the image surface 44, a transparent film having the positive image to be created is placed against the image surface 44. The image is normally comprised of black and clear areas. With the transparent film with the image thereon against the image surface 44, the ink cartridge 36 is placed in a sealed light box with the image surface 44 pressed against a clear glass or plastic member. A xenon light is placed in the light box below the image surface 44 and energized for a predetermined time. The rays from the xenon light irradiate the image surface 44 through the transparent film wherever there were clear image areas. This causes a chemical reaction fusing the foam from the heat. This seals what were the clear areas resulting in areas that are non-permeable to the ink passing through the image forming layer 42. The rays do not penetrate the black image areas on the film and thus no reaction occurs on the image surface 44. These areas remain unsealed and thus ink permeable. Thus, the image 46 is formed. Machinery for this stamp forming process is available in the industry. Other methods to form the image 46 on the image forming layer 42 are available which provide ink permeable and ink impermeable areas to define the image.

The ink cartridge 36 is dimensioned so that it is snugly received within the perimeter of the ledge 30 with the image forming layer 42 extending slightly below the bottom 20. This allows the image forming layer 42 to be retained within the frame member 12 yet allows the image forming layer 42 to extend below the bottom 20 of the frame member 12 for printing.

As previously described, the outer edge 38 frames the image surface 44. None of the image 46 is intended to be in the outer edge 38. The width of the outer edge 38 is substantially the same as the width of the ledge 30. An adhesive is applied to the ledge 30 and covered with a removable covering (not illustrated). Alternatively a double sided tape is applied to the ledge with one side of the tape exposed and affixed to the ledge 30 and the other side of the tape left covered until the stamp member is to be affixed to the ledge 30. Another alternative is applying liquid glue to the ledge 30. Utilizing any of these methods will achieve the purpose of affixing the image forming stamp member 14 to the ledge 30.

Once the image is formed on the image forming layer 42 and the ink cartridge 36 is securely attached to the ledge 30, the ink cartridge 36 is loaded with ink. This is done by the user pouring, injecting or dripping a predetermined quantity of printing ink into the ink entrance holes 32, 34. The baffles 26 and ink channels 28 control the ink flow from the ink entrance holes 32, 34 toward the ledge 30 surrounding the inside of the frame member 12. The ink should not saturate the outer edge area 38 where the ink cartridge 36 is fastened to the ledge 30 or it will compromise the adhesive bond that retains the ink cartridge 36 to the ledge 30. When no ink remains in the cartridge 36 or when it dries out, the ink cartridge 36 can be re-inked. This is accomplished by merely pouring the predetermined quantity of ink into the ink entrance holes 32 and 34.

The bottom tray 16 located between the first stamp 8 and the second stamp 9 and between the second stamp 9 and the third stamp 10, is comprised of a tray bottom 48, and an upstanding wall 50 extending about the perimeter of the bottom tray 16. The upstanding wall 50 and tray bottom 48 define an open top cavity. The upstanding wall 50 has a top edge 52 and a shoulder portion 54 extending about the perimeter of the wall 50. A centrally disposed square center post 56 protrudes downward from the tray bottom 48. The square center post 56 has a hollow central core.

A square receiving channel 58 dimensioned to closely receive the square center post 56 is located in the top 18 of each of the frame members 12. The square center post 56 of the first stamp 8 is snugly but releasably received in the square receiving channel 58 of the frame member 12 of the second stamp 9. In the same manner, the bottom tray 16 of the second stamp 9 is received in the top 18 of the third stamp 10. The bottom tray 16 thus forms an interface or transition member between the first stamp 8, the second stamp 9 and the third stamp 10. Additional stamps can be stacked in the same manner.

One function of the bottom tray 16 is that it covers the image forming stamp member 14. The upstanding wall 50 is snugly but releasably received in the receiving groove or channel 31. The wall 50 is pushed into the groove 31 until the bottom 20 engages the shoulder 54. An air space is formed between the image surface 44 and the tray bottom 48 to protect the image surface 44.

To complete assembly of the stamp 6, a handle cover 60 is attached to the top or first stamp 8. The handle cover 60 has a square center post 62 molded into the cover 60. This is closely received in the square receiving channel 58 at the top 18 of the first stamp 8. A bottom dust cover 64 is attached to the bottom of the third stamp 10. The bottom dust cover 64 is identical to the bottom tray 16 except that there is no protruding square center post 54. Instead the bottom of the dust cover is flat to protect the third stamp's image forming stamp member 14 and to insure that the image 46 is not accidentally transferred to surfaces or objects. It also provides a flat surface on which the assembled stamp 6 can rest in a vertical position. In order to use any of the stamps, the bottom tray 16 or the dust cover 64 is removed which exposes the image surface 44. The image surface 44 is placed in contact with the image receiving surface and pressed against it, transferring the image 46. The bottom tray 16 or dust cover 64 is replaced when the stamping is finished.

Figure 2:
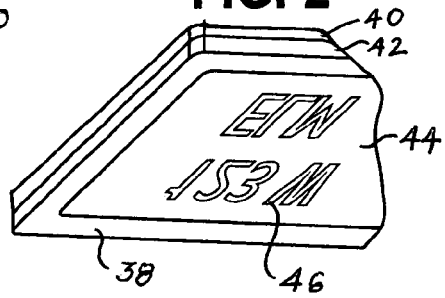
FIG. 2 is an enlarged view of the area indicated in the circle of FIG. 1 showing the first embodiment of an image forming stamping member with the image formed on a foam pad.
Figure 3:
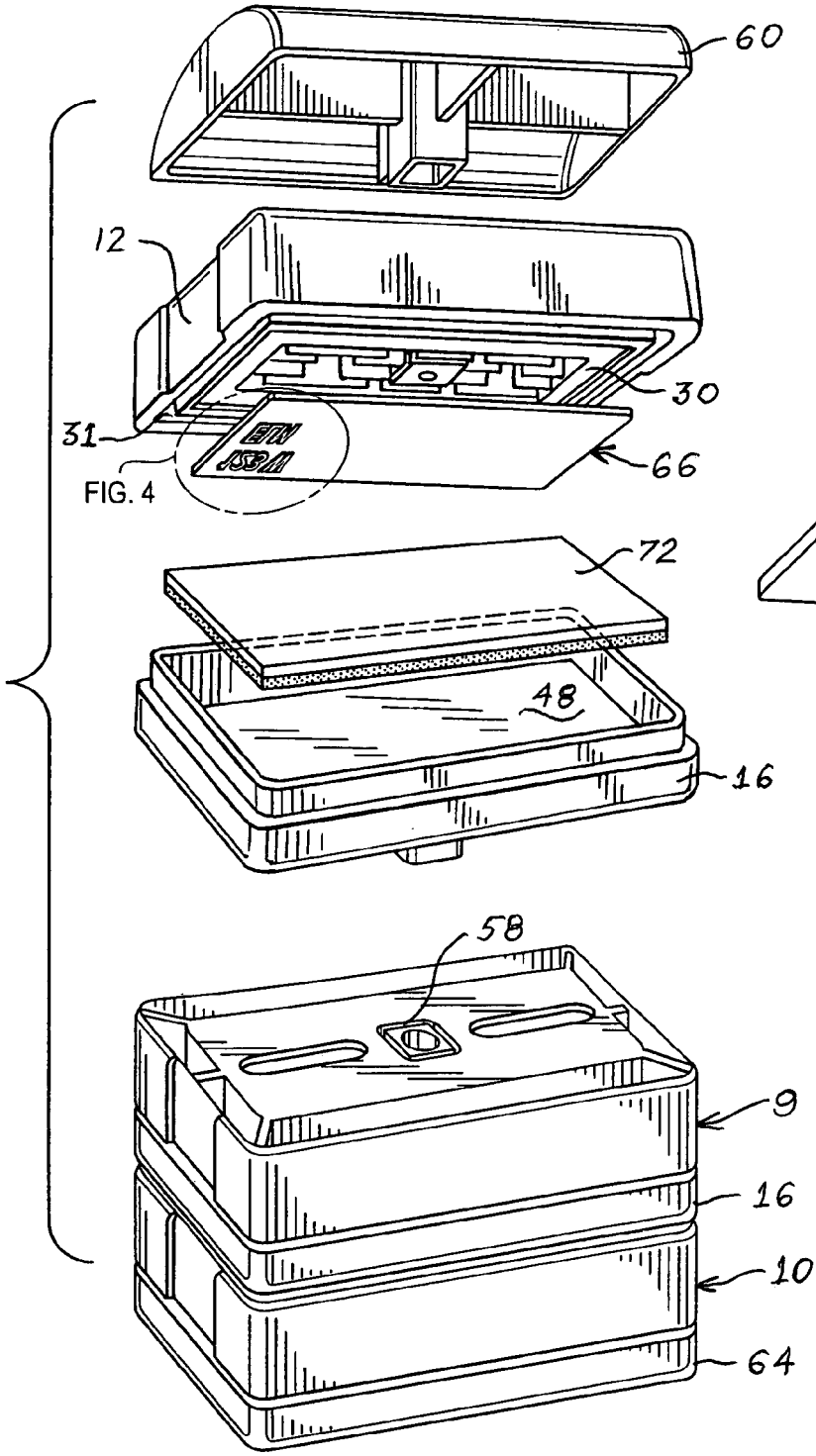
FIG. 3 is an exploded perspective view of a stackable hand stamp illustrating a second embodiment of a hand stamp with an image forming stamp member having a rubber die with raised indicia thereon for forming the image adapted for mounting on the frame member.
Figure 4:
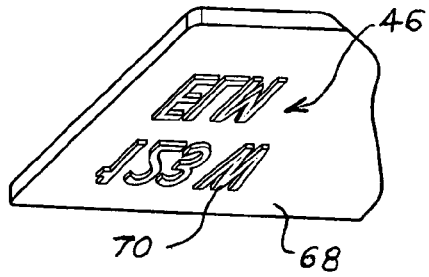
FIG. 4 is an enlarged view of the area indicated in the circle of FIG. 3 showing the second embodiment of the image forming stamping member with the image being raised on the rubber die.

The second or alternative embodiment is illustrated in FIGS. 3 and 4. All of the components are identical to the first embodiment illustrated in FIGS. 1 and 2 except for the image forming stamping member 14. Here an image forming stamping member 66 is comprised of a flexible rubber die 68 having raised letters, numbers or other indicia 70 thereon. The die 68 is mounted to the ledge 30 of the frame member 12 by adhesive or other conventional means. An inkpad 72 of conventional design is placed in the bottom tray 16. When the frame member 12 receives the upstanding wall 50 of bottom tray in the receiving groove 31, the raised indicia 70 on the die 68 contact the inkpad 72. This transfers ink from the inkpad 72 to the raised indicia 70. Rubber die 68 is then ready to transfer the image 46 to the image receiving surface.

Each of the second and third stamps 9, 10 can have the image forming stamping member comprised of the die 68 and inkpad 72. The bottom tray 16 serves the dual purpose of protecting the rubber die 68 and retaining the inkpad 72. The inkpad 72 can be re-inked as necessary.

The design of the frame member 12 allows either the ink cartridge 36 or the rubber die 68 to be mounted to the edge 30. Also, the bottom tray 16 functions as both a cover and an inkpad storage receptacle so that it can be used with either image forming stamping member 14 or 66. As the frame members 12 are identical, the design also allows a combination of stamps using the ink cartridge design 36 and flexible die 68. This design allows the interchangeability and combination of two different stamp designs in a single stackable hand stamp Thus there has been provided a stackable hand stamp that fully satisfies the objects and advantages set forth herein. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A stackable hand stamp assembly comprising:

a first frame member having a top, a bottom, and sidewalls;

a second frame member substantially identical to the first frame member and having a top, a bottom and sidewalls;

a ledge extending inward from the sidewalls of each of the first and second frame members;

an image forming stamping member mounted to the ledge of each of the frame members;

a first bottom tray removably attached to the bottom of the first frame member for selectively covering or exposing the bottom of the first frame member;

a second bottom tray removabley attached to bottom of the second frame member for selectively covering or exposing the bottom of the second frame member; and mounting means protruding from the first bottom tray for attaching the first bottom tray to the top of the second frame member;

whereby the first frame member and first bottom tray can be removably mounted on top of the second frame member, and the image forming stamping members mounted to the first frame member and second frame member can be selectivley covered or exposed.

2. The stackable hand stamp assembly of claim 1 wherein the image forming stamping member is selected from the group comprising a flexible member with raised indicia thereon for receiving ink and an ink cartridge having ink permeable and ink impermeable portions defining an image, with the ink from the cartridge flowing through the ink permeable portions for transferring the image to an image receiving means.

3. The stackable hand stamp assembly of claim 1 and further comprising receiving means in the top of the second frame member for receiving the mounting means protruding from the first bottom tray for attaching the first bottom tray to the top of the second frame member.

4. The stackable hand stamp assembly of claim 3 wherein the receiving means comprises a slot formed in the top of the second frame member for frictionally receiving the mounting means.

5. The stackable hand stamp assembly of claim 4 wherein the mounting means comprises a rectangular post protruding from the first bottom tray.

6. The stackable hand stamp assembly of claim 1 and further comprising a handle removably attached to the top of the first frame member.

7. The stackable hand stamp assembly of claim 6 and further comprising handle mounting means protruding from the handle for attaching the handle to the top of the first frame member.

8. The stackable hand stamp assembly of claim 7 and further comprising handle mounting receiving means in the top of the first frame member for receiving the handle mounting means protruding from the handle.

9. The stackable hand stamp assembly of claim 8 wherein the handle mounting receiving means comprises a handle receiving slot formed in the top of the first frame member for frictionally receiving the handle mounting means.

10. The stackable hand stamp assembly of claim 9 wherein the handle mounting means comprises a rectangular post protruding from the handle.

11. The stackable hand stamp assembly of claim 2 and further comprising ink receiving means located on the top of the first and second frame members for receiving and disbursing ink to the cartridge.

12. The stackable hand stamp assembly of claim 2 and further comprising an ink pad mounted in the first bottom tray in contact with the raised indicia for applying ink to the raised indicia on the flexible member mounted to the first frame member.

13. The stackable hand stamp assembly of claim 12 and further comprising a second ink pad mounted in the second bottom tray in contact with the raised indicia for applying ink to the raised indicia on the flexible member mounted to the second frame member.

14. The stackable hand stamp of claim 1 and further comprising a third frame member substantially identical to the first and second frame members, with a top, a bottom and a ledge for receiving a third image forming stamping member, and a third bottom tray removably attached to the bottom of the third frame member for selectively covering or exposing the bottom of the third frame member, whereby the second frame member and second bottom tray can be removably mounted on top of the third frame member.

15. A hand stamp comprising:

a first stackable stamp comprising a first frame member with a top, a bottom, and sidewalls, a first image forming stamping member mounted to the bottom of the first frame member, a first bottom tray removably attached to the bottom of the first frame member for selectively covering or exposing the bottom of the first frame member, a second stackable stamp comprising a second frame member with a top, a bottom, and sidewalls, a second image forming stamping member mounted to the bottom of the second frame member, a second bottom tray removably attached to the bottom of the second frame member for selectively covering or exposing the bottom of the second frame member, mounting means for attaching the first bottom tray to the top of the second frame member.

16. The hand stamp of claim 15 wherein the mounting means comprises a protruding post extending from the bottom of the first tray and a complementary receiving slot in the top of the second frame which receives the post in frictional engagement.

17. The hand stamp of claim 16 and further comprising a handle removably attached to the top of the first frame member.

18. The hand stamp of claim 15 wherein the first and second image forming stamping members are selected from the group comprising a flexible member with raised indicia thereon for receiving ink and an ink cartridge having ink permeable and ink impermeable portions defining an image, with the ink from the cartridge flowing through the ink permeable portions for transferring the image to an image receiving means.

19. The hand stamp of claim 18 and further comprising an ink pad mounted in the bottom tray when the flexible member with raised indicia is selected for applying ink to the raised indicia.

20. The hand stamp of claim 15 and further comprising a ledge extending inward from the sidewalls of each of the first and second frame members for mounting the image forming stamping member thereon.

21. The hand stamp of claim 15 and further comprising a third stackable stamp comprising a third frame member with a top, a bottom, and sidewalls, a third image forming stamping member mounted to the bottom of the third frame member, a third bottom tray removably attached to the bottom of the third frame member for selectively covering or exposing the bottom of the third frame member, and mounting means for removably attaching the second bottom tray to the top of the third frame member.

* * * * *